US008698650B2

(12) United States Patent
Bunz et al.

(10) Patent No.: US 8,698,650 B2
(45) Date of Patent: Apr. 15, 2014

(54) METHOD FOR OPTIMIZING THE TRAFFIC CONTROL AT A TRAFFIC SIGNAL CONTROLLED INTERSECTION IN A ROAD TRAFFIC NETWORK

(75) Inventors: Martin Bunz, Augsburg (DE); Jürgen Mück, München (DE); Andreas Poschinger, Wolfratshausen (DE); Reinhold Tannert, Maisach-Gernlinden (DE)

(73) Assignee: Siemens Aktiengesellschaft, Munich (DE)

( * ) Notice: Subject to any disclaimer, the term of this patent is extended or adjusted under 35 U.S.C. 154(b) by 251 days.

(21) Appl. No.: 13/121,841

(22) PCT Filed: Jul. 27, 2009

(86) PCT No.: PCT/EP2009/059647

§ 371 (c)(1),
(2), (4) Date: Mar. 30, 2011

(87) PCT Pub. No.: WO2010/037581

PCT Pub. Date: Apr. 8, 2010

(65) Prior Publication Data

US 2011/0181440 A1 Jul. 28, 2011

(30) Foreign Application Priority Data

Sep. 30, 2008 (DE) ..... 10 2008 049 568

(51) Int. Cl.
*G08G 1/095* (2006.01)

(52) U.S. Cl.
USPC ..... 340/907; 340/906; 340/916; 340/917; 701/117; 701/118; 701/119

(58) Field of Classification Search
USPC ..... 340/907, 916, 906, 917, 931; 701/115–119, 213
See application file for complete search history.

(56) References Cited

U.S. PATENT DOCUMENTS

2008/0235398 A1 9/2008 Helbing et al.

FOREIGN PATENT DOCUMENTS

CN 101038700 A 9/2007
CN 101042805 A 9/2007

(Continued)

OTHER PUBLICATIONS

Friedrich et al.: "Strategisches Verkehrsmanagement—Eine konsistente Theorie und ihre Umsetzung", Tagungsband Heureka,Forschungsgesellschaft für Straβen- und Verkehrswesen,, Mar. 6-7, 2002, pp. 1-9, Köln, Germany (URL: http://www.ivh.uni-hannover.de/peb/de/Mitarbeiter/friedrich-Dateien/veroeffentlichungen/Strategisches%20Verkehrsmanagement%20(final).pdf)—Statement of Relevance.

(Continued)

*Primary Examiner* — Hoi Lau
(74) *Attorney, Agent, or Firm* — Laurence A. Greenberg; Werner H. Stemer; Ralph E. Locher

(57) ABSTRACT

A method of optimizing the traffic control at a traffic signal-controlled intersection in a road traffic network. The vehicle traffic in entrances to the intersection are controlled by signal groups of a traffic signal system according to associated signal times. For vehicles approaching the signal group, traffic parameters are determined from traffic data using a traffic model according to the signal times, and in order to determine optimal signal times, the traffic parameters are weighted and added up and the target function formed in such a way is optimized by varying the signal times. By individually determining the traffic parameters for each vehicle and individually weighting the traffic parameters according to the strategic relevance thereof for the implementation of a specified traffic strategy, an improved implementation of the specified traffic strategy is made possible.

9 Claims, 1 Drawing Sheet

(56) References Cited

FOREIGN PATENT DOCUMENTS

| | | | |
|---|---|---|---|
| CN | 101251953 | A | 8/2008 |
| DE | 10 2005 023 742 | A1 | 11/2006 |
| WO | 97/34274 | A1 | 9/1997 |

OTHER PUBLICATIONS

Siemens AG, "Versatzoptinnierung im Strassennetz VERO, Beschreibung, Strassenverkehrtechnik",1994, pp. 1-50, Edition Nov. 1994, Order No. A24705-X-A367-*-04, Munich, Germany.

Wu, et al. "Discrete Intersection Signal Control", in IEEE International Conference on Service Operations and Logistics, and Informatics, Aug. 27-29, 2007, pp. 1-6, ISBN: 978-1-4244-1118-4.

Yan, et al. "Control of traffic lights in intersection: A new branch and bound approach" in IEEE International Conference on Service Systems and Service Management, Jun. 30-Jul. 2 2008, pp. 1-6, ISBN: 978-1-4244-1671-4.

Friedrich, et al., "Strategisches Verkehrsmanagement—Eine Konsistente Theorie und ihre Umsetzung" Tagungsband Heureka, Forschungsgesellschaft für Strassen- und Verkehrswesen, Mar. 6-7, 2002, pp. 1-9, Köln, Germany (URL: Http://www.ivh.uni-hannover.de/peb/de/Mitarbeiter/friedrich-Dateien/veroeffentlichungen/Strategisches%20Verkehrsmanagement%20(final).pdf).

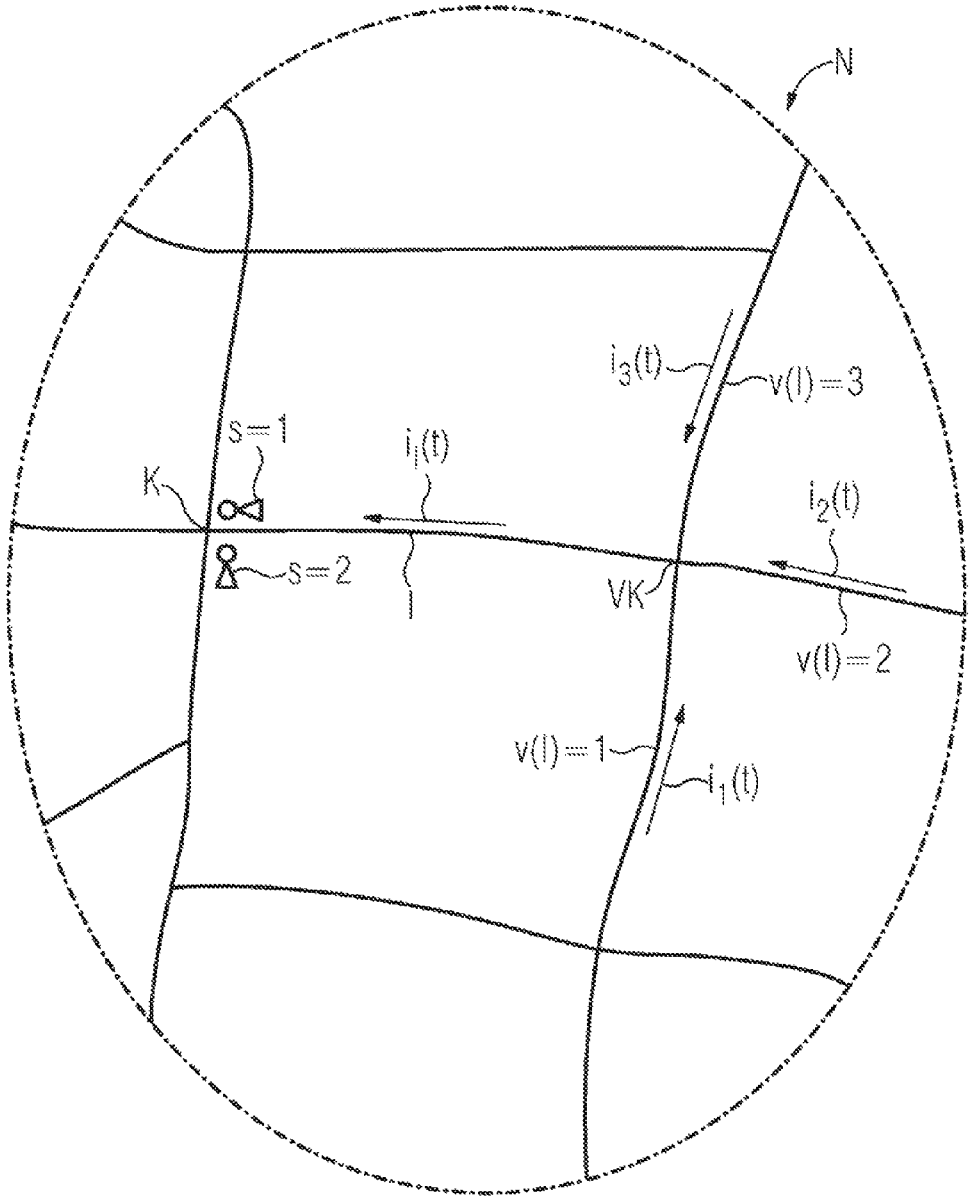
N
$i_3(t)$
v(l)=3
s=1
$i_1(t)$
K
$i_2(t)$
s=2
VK
v(l)=2
v(l)=1
$i_1(t)$

METHOD FOR OPTIMIZING THE TRAFFIC CONTROL AT A TRAFFIC SIGNAL CONTROLLED INTERSECTION IN A ROAD TRAFFIC NETWORK

BACKGROUND OF THE INVENTION

Field of Invention

The invention relates to a method for optimizing the traffic control at a traffic signal controlled intersection in a road traffic network, the vehicle traffic in entries to the intersection being controlled by signal groups of a traffic signal system according to assigned signal times, for vehicles approaching the signal group traffic parameters being determined from traffic data with the aid of a traffic model as a function of the signal times, and the traffic parameters being weighted and summed for the purpose of determining optimum signal times, and the target function formed in such a way being optimized by varying signal times.

In inner city road traffic networks, the vehicle traffic in entries to intersection points is controlled by traffic signal systems. A traffic signal system comprises signal transmitters that are grouped to form signal groups for different traffic flows and which are designed to output light signals to the road user. A main traffic direction and a secondary traffic direction that are controlled by dedicated signal groups typically cross over at an intersection point. The traffic signal system further comprises a control unit in which a signal program runs in order to switch on the signal groups in accordance with specific signal times. For each signal group, the signal times comprise green times, defined by the instance of green begin and green end within a cycle time, and a phase sequence of red phases blocking the vehicle traffic and green phases clearing the latter. Fundamentally, a distinction is made between fixed time signal controls with fixed signal times for example dependent on the time of day, without possibilities for road users to intervene traffic dependent signal controls in the case of which the road users can influence the signal program. In the case of controls dependent partly or wholly on traffic, the signal program is prescribed as a framework signal plan whose phase transitions are invariable given compliance with intermediate times, but whose durations can, if necessary, be extended or compressed within prescribable allowed ranges. The signal programs of neighboring intersections are coordinated in order to use traffic signal systems to control the traffic cycle through a plurality of intersections. Here, the green times are coordinated with one another by temporal offset of the signal programs in such a way that, for example, the plurality of the vehicles can pass a plurality of intersections without stopping while maintaining a specific speed.

The selection of the phase sequence, the selection of the cycle time, the distribution of green times and the dimensioning of offset times are to be performed optimally for the intersection points in the road network. This is valid both for the optimization of planning with traffic data determined in advance, and for methods for optimizing the traffic cycle that are based on currently measured traffic data. Known optimization methods vary the phase sequence selection, the cycle time selection, the green time distribution and the offset times so as to produce an optimum value of a target function that is formed as a weighted sum of traffic parameters.

There is known from the brochure "Versatzoptimierung im Straβennetz: VERO", ["Offset optimization in the road network: VERO"], published November 1994 by Siemens AG, Order No. A24705-X-A367-*-04, a method for optimizing the coordination of traffic signal systems in a road network that proceeds from the intensity distributions of the individual inflows at a traffic signal system, that is to say the breakdown of the traffic intensity respectively approaching the end of the entry. Optimum offset times are determined between the signal programs of the intersection currently to be coordinated, and the neighboring intersection(s) already coordinated. To this end, a target function in the form of a weighted sum of waiting times and numbers of stops experienced by vehicles belonging to vehicle bunches moving between the last intersection and the intersection currently to be coordinated is minimized. The waiting times and numbers of stops are dependent in this case on the phase sequences of the signal programs of these intersections, on the offset time between the signal programs, and on the intensity distributions modeling vehicle bunches.

It is possible to use this known method to undertake a weighting of the traffic parameters per intersection and per signal group. It is hereby possible for waiting times and stops experienced by vehicles that pass the intersection in the main direction to be weighted otherwise than for vehicles that cross said intersection in a secondary direction. However, the weighting is valid for all vehicles approaching the signal groups of an intersection. It follows that the known method can be used only with great limitations to implement traffic strategy stipulations—such as, for example, to promote specific driving relationships or to actuate partial green waves that are, however, perceived as positive by the user.

BRIEF SUMMARY OF THE INVENTION

It is therefore the object of the invention to provide an optimization method of the type mentioned at the beginning that more effectively enables an improved implementation of prescribed traffic strategies.

The object is achieved according to the invention by a generic optimization method as claimed. Owing to the fact that the traffic parameters, that is to say by way of example the number of stops and the waiting times for each vehicle, are determined individually and weighted individually in accordance with their strategic relevance for the implementation of a prescribed traffic strategy, it is possible to perform a differentiated evaluation of the traffic parameters, if appropriate by individual vehicle, and thus to favor or hinder specific traffic profiles of the vehicles. In this way, prescribed traffic strategies, for example, the concentration of the traffic on main traffic arteries of substantially better quality can be implemented by targeted modeling of the weights. With reference to a traffic strategy to be implemented, it is possible for traffic parameters of different vehicles to have a different strategic relevance, for example depending on their previous travel route. Both spatiotemporal relationships and the qualitative perception of the road users can also be modeled using the specific weightings. Consequently, traffic strategy stipulations are accessible to mathematical modeling and can be taken in account explicitly by the optimization.

In a preferred embodiment of the inventive method, an evaluation period is subdivided into discrete time intervals, and for each time interval the traffic parameters of vehicles with the same strategic relevance are combined and collectively weighted. An evaluation period can in this case extend from the duration of a signal cycle of the signal group up to a multiplicity of signal cycles, depending on which time horizon is expedient for the simulation. A separate weighting is hereby rendered possible for vehicle populations of a time interval with equal strategic relevance.

In an alternative preferred embodiment of the inventive method, an evaluation period is subdivided into discrete time intervals, and depending on the strategic relevance of the traffic parameters a strategy relevance profile is modeled with the aid of which the traffic parameters of vehicles of this strategic relevance in this time interval are individually weighted. The strategy relevance profiles specify as a function of time the weightings with which the traffic parameters of vehicles of a specific strategic relevance in a time interval are input into the target function.

It is preferred to model a collective strategy relevance profile with the aid of which the traffic parameters of vehicles of all the strategic relevances of in each case one time interval are weighted in common. A collective strategy relevance profile specifies as a function of time the weightings with which the traffic parameters of all vehicles in a specific time interval are input into the target function. The loss of individual vehicle weighting of the traffic parameters is compensated here by the saving in computing time for the simulation and/or optimization owing to the simplification in the modeling with a lesser number of variables.

In an advantageous refinement of the inventive method, account is taken of the travel history of a vehicle as the strategic relevance of the traffic parameters of said vehicle. Taking account of the travel history of a vehicle permits specific travel profiles to be deliberately promoted or disadvantaged by including the fate of the vehicle at previous intersections, and/or entries thereof, lying on the completed travel route in the evaluation of the traffic parameters for the target function.

In a preferred refinement of the inventive method, the origin of the vehicle from a main direction entry or a secondary direction entry is taken into account as the strategic relevance of the traffic parameters of a vehicle. The different weighting of the traffic parameters of vehicles from different sources supports, by way of example, the different strategic relevances of waiting times and stops experienced by vehicles approaching the previous intersection on main direction entries and secondary direction entries.

If, for example, the aim is to use a concentration of the vehicle movements on main traffic arteries as the traffic strategy, the traffic parameters of the vehicles coming from a main direction entry are to be more strongly weighted than those where vehicles come from a secondary direction entry.

In an advantageous embodiment of the inventive method, the waiting times and/or numbers of stops experienced by the vehicle at least one previous intersection are taken into account as the strategic relevance of the traffic parameters of a vehicle. Thus, for example, the stops and waiting times of vehicles that have been driving for some time on a main traffic artery, or of such vehicles that have already had to experience one or more stops on the main traffic artery are weighted more strongly than is the case for other vehicles. The quality of a green wave that is perceived by a road user is intended to be good—this, too, can also be a road traffic strategy that is to be implemented. Here, the traffic parameters of vehicles already moving on the main artery are to be heavily weighted, while vehicles turning in from secondary direction entries on the main artery may also stop more often. If this is not desired, a further strategic stipulation can be that vehicles turning into the main direction must stop at most once before they are also coordinated in the main direction bunch. In this case, the weightings of the stops and waiting times of these vehicles are raised as soon as they have had to stop once.

In a further preferred embodiment of the inventive method, the target function is formed from two weighted partial sums in a partial sum of which the traffic parameters are summed in a separately weighted fashion according to a method as claimed in one of claims 1 to 7, and in the other partial sum of which the traffic parameters are summed in an equally weighted fashion for all vehicles approaching a signal group. Whereas the first partial sum is used to calculate a system optimum for all vehicles, the second partial sum is aimed at a strategic optimum for individual vehicles, or a selection of vehicles. Via the weighting of the partial sums, it can be prescribed to what extent, or whether at all, the system optimum is to be regarded as a second optimization criterion alongside the strategic optimum.

BRIEF DESCRIPTION OF THE SEVERAL VIEWS OF THE DRAWING

Further properties and advantages of the inventive optimization method are explained below with the aid of an exemplary embodiment illustrated in the drawing, in the single FIGURE of which a segment of a road network is illustrated schematically.

DESCRIPTION OF THE INVENTION

In accordance with the FIGURE, the sections between each two intersections K or VK of a road traffic network N, which represent the entries to the respective intersection point K, are numbered using a counting index 1. The intersection K and its previous intersection VK lie on a main traffic artery on which the vehicle traffic is to be concentrated according to a traffic strategy stipulation. The traffic at the intersection K is controlled by a traffic signal system that has a main direction signal group s=1 and a secondary direction signal group s=2, and likewise at the previous intersection VK (not illustrated in the FIGURE, however), whose signal times are to be optimized by means of the inventive method.

The state of the system is now modeled as follows with the aid of a traffic flow model. An evaluation period that is limited in the case of systems in the steady state to the duration of a signal cycle [0; $t_u$-1] of the signal groups s is subdivided into discrete time intervals t of 1 sec. Stored for each entry 1 and each time interval t is an intensity profile $i_1(t)$, which corresponds to the instantaneous traffic intensity of the traffic flowing on the entry 1, and a collective strategy relevance profile $k_1(t)$, which corresponds to a weighting of waiting times $w_s(t)$ and stops $h_s(t)$ of vehicles that approach the entry 1 of the signal group s in the time interval t. The collective strategy relevance profile $k_1(t)$ weights the mean strategic relevance of the traffic parameters $w_s(t)$ and $h_s(t)$, respectively, of all vehicles of a time interval t in only one variable, and this is attended by the advantage of a substantial saving in computing time.

The constant value 50 is allocated to the collective strategy relevance profile $k_1(t)$ at the edge of the network N, for example the entry v(1)=2, when this entry is a main direction entry with a non-vanishing traffic intensity $i_1(t)>0$, otherwise the value 0 is allocated. The values of the strategy relevance profile $k_1(t)$ for the remaining entries 1 are determined by weighting of the values of the strategy relevance profile $k_{v(1)}(t)$ for the predecessor entries v(1) of the entry 1. In the FIGURE, the entry 1 relating to the intersection K has three predecessor entries v(1)=1, 2, 3 ending at the previous network VK, specifically a main direction entry v(1)=2 and two secondary direction entries v(1)=1 and v(1)=3. In general, the entry 1 may have a total of V predecessor entries. The weighting is performed with the aid of the intensity profiles $i_{v(1)}(t)$ sent by the predecessor entries v(1), and with the aid of the turn-off rates $a_{v(1),1}(t)$, which indicates the portion of the traffic intensity $i_{v(1)}(t)$ that drives or turns off from the predecessor entry v(1) into the entry 1:

$$k_1(t) = \frac{\sum_{v(1)=1}^{V} a_{v(1),1}(t) \cdot i_{v(1)}(t - tr(v(1))) \cdot k_{v(1)}(t)}{\sum_{v(1)=1}^{V} a_{v(1),1}(t) \cdot i_{v(1)}(t - tr(v(1)))}.$$

Here, tr(v(1)) signifies the mean travel time that is required for the predecessor entry v(1).

There now form at the signal groups s queues at which the values of the collective strategy relevance profile $k_s(t)$ is determined using the following equation:

$$k_s(t) = \frac{k_s(t-1) \cdot w_s(t-1) + k_1(t) \cdot i_1(t)}{w_s(t-1) \cdot i_1(t)}.$$

Thus, what is involved here is a mean weighting for the vehicles in the queue into which there are input the mean weighting and the waiting times of the previous time interval t-1.

It is also possible in principle to model the queues so that only vehicles with an identical value of the strategy relevance profile are summed; the queue then has a plurality of time-sorted vehicle populations each having an identical strategy relevance profile value. This improved mapping of the strategic relevances is, however, offset by an increased computing time.

However, the approach is of no use if all the vehicles whose value of the strategy relevance profile is greater than zero do not come to a stop in the queue.

The target function PI will now be determined via the evaluation period in the following equation:

$$PI = \sum_{t=0}^{t_U-1} \sum_{s=1}^{S} [(\alpha_s \cdot w_s(t) + \beta_s \cdot h_s(t)) + k_s(t) \cdot (\delta_s \cdot w_s(t) + \varepsilon_s \cdot h_s(t))].$$

In a simple design, use may be made of a model for the steady state. It is possible hereby to limit the evaluation period to a signal cycle [0; $t_u$-1]. All the signal groups s=1, . . . , S are considered. Instead of the mean, collective strategy relevance profile $k_s(t)$, the waiting times and stops can also be weighted separately by their respective strategic relevance with individual strategy relevance profiles. The weightings $\alpha_s$ and $\beta_s$ are the conventional weightings of the system optimum. If the aim is to calculate exclusively a strategic optimum with regard to a traffic strategy stipulation, this can be set at 0. The strategy relevance profile $k_s(t)$ is both a function of location, that is to say at least at the location of the signal group s, and dependent on time. The weightings $\delta_s$ and $E_s$ specify how heavily the strategy relevance profile is to be weighted at a signal group s.

In conjunction with the present invention, the term of traffic strategy can be understood both as a higher-level stipulation, required for reasons of traffic policy, for example, for the management of town center traffic, for example "green waves in main traffic directions", and one or more lower-level partial goals aimed at achieving a higher-level stipulation, for example "right of way to the main direction" and "no excessively large impairment of the secondary direction". The strategic relevance is understood as the transformation of the partial goals into boundary conditions that can be mathematically modeled, for example "vehicles in the main direction should not have to stop, vehicles in the secondary direction should stop at most once". A strategy relevance profile specifies a temporal course of a measure with which the strategic relevance is satisfied, for example "stopped n times too often". The strategy relevance profile is used as a weighting with which a traffic parameter is taken into account in the target function in order to be able to calculate optimum signal times with regard to the traffic strategy.

The invention claimed is:

1. A method for optimizing a traffic control at a traffic signal-controlled intersection in a road traffic network, the method which comprises:

controlling vehicle traffic in entries to the intersection by traffic signal groups of a traffic signal system according to respective traffic signal times;

determining traffic parameters, individually for each vehicle approaching the traffic signal group, from traffic data with the aid of a traffic model as a function of the traffic signal times;

weighting the traffic parameters individually according to a strategic relevance of the traffic parameters to an implementation of a prescribed traffic strategy, wherein a strategic relevance of the traffic parameters is modeled by at least one time-dependent strategy relevance profile, and summing the traffic parameters for determining optimum traffic signal times; and optimizing a target function thus formed by varying the traffic signal times.

2. The optimization method according to claim 1, which comprises dividing an evaluation period into discrete time intervals, and for each time interval, combining and collectively weighting the traffic parameters of those vehicles having a common strategic relevance.

3. The optimization method according to claim 1, which comprises dividing an evaluation period into discrete time intervals, and depending on the strategic relevance of the traffic parameters, modeling a strategy relevance profile with the aid of which the traffic parameters of vehicles having the given strategic relevance in this time interval are individually weighted.

4. The optimization method according to claim 3, which comprises modeling a collective strategy relevance profile with the aid of which the traffic parameters of vehicles of all the strategic relevances belonging to a common time interval are weighted in common.

5. The optimization method according to claim 4, which comprises taking into account a travel history of a given vehicle as the strategic relevance of the traffic parameters of the given vehicle.

6. The optimization method according to claim 5, which comprises taking into account an origin of the given vehicle from a main direction entry or a secondary direction entry as the strategic relevance of the traffic parameters of the given vehicle.

7. The optimization method according to claim 4, which comprises taking into account an origin of a given vehicle from a main direction entry or a secondary direction entry as the strategic relevance of the traffic parameters of the given vehicle.

8. The optimization method according to claim 1, which comprises taking into account waiting times and/or numbers of stops suffered by a given vehicle at at least one previous intersection as the strategic relevance of the traffic parameters of the given vehicle.

9. The optimization method according to claim 1, which comprises:

forming the target function from two weighted partial sums;

forming one of the partial sums by summing the traffic parameters in a separately weighted fashion according to the step of weighting the traffic parameters and the step of summing the traffic parameters according to claim 9; and forming another partial sum by summing the traffic parameters in an equally weighted fashion for all vehicles approaching a traffic signal group.

* * * * *